United States Patent [19]

Sasaki

[11] Patent Number: 4,658,881

[45] Date of Patent: Apr. 21, 1987

[54] CASTING APPARATUS FOR PROVIDING CONTROLLED AMBIENT DURING PRODUCTION CASTING

[75] Inventor: Nobuyoshi Sasaki, Yokohama, Japan

[73] Assignee: M. C. L. Co., Ltd., Japan

[21] Appl. No.: 835,450

[22] Filed: Feb. 28, 1986

Related U.S. Application Data

[63] Continuation of Ser. No. 623,367, Jun. 22, 1984, abandoned.

[30] Foreign Application Priority Data

Jun. 29, 1983 [JP] Japan ..... 58-118788
Jun. 29, 1983 [JP] Japan ..... 58-115788

[51] Int. Cl.[4] ..... B22D 18/06
[52] U.S. Cl. ..... 164/256; 164/61; 164/66.1
[58] Field of Search ..... 164/61, 66.1, 256, 259

[56] References Cited

U.S. PATENT DOCUMENTS

| | | | |
|---|---|---|---|
| 2,308,395 | 1/1943 | Smithson | 164/256 |
| 3,410,332 | 11/1968 | Woodburn | 164/61 |
| 3,470,936 | 10/1969 | Jandras | 164/61 |
| 3,800,848 | 4/1974 | Chaulet | 164/256 |
| 3,863,706 | 2/1975 | Chandley | 164/256 |

FOREIGN PATENT DOCUMENTS

| | | | |
|---|---|---|---|
| 486863 | 1/1976 | U.S.S.R. | 164/256 |

*Primary Examiner*—Nicholas P. Godici
*Assistant Examiner*—Gerard Reid
*Attorney, Agent, or Firm*—Laff, Whitesel, Conte & Saret

[57] ABSTRACT

A casting apparatus having a casting chamber which may be sealingly closed is provided. The casting chamber is evacuated and then an inert gas or a reducing gas is introduced prior to the casting operation. A ladle for containing a one-shot molten metal is disposed on the casting chamber to be evacuated simultaneously with the evacuation of the casting chamber and then surrounded by an inert or reducing gas atmosphere during the casting operation.

5 Claims, 5 Drawing Figures

CASTING APPARATUS FOR PROVIDING CONTROLLED AMBIENT DURING PRODUCTION CASTING

This is a continuation of U.S. patent application Ser. No. 623,367, filed June 22, 1984, now abandoned.

BACKGROUND OF THE INVENTION

1. Field of Art

The present invention relates to a casting apparatus for casting a molten metal in a mold efficiently and safely in an inert or reducing gas atmosphere.

2. Prior Art

In casting an inflammable light alloy, such as a magnesium alloy, the molten alloy is cast in an inert or reducing gas atmosphere to prevent oxidation of the molten alloy. Examples of the inert or reducing gas used in the prior art processes are sulfur hexafluoride ($SF_6$), carbon monoxide (CO) and sulfurous acid gas ($SO_2$). However, in the conventional processes, a sintered mold is put in a chamber having an opened top and then one of the aforementioned inert or reducing gases is allowed to flow into the chamber to purge air with the flowing inert or reducing gas while making use of the fact that such an inert or reducing gas heavier than air. This purging operation in the conventional processes must be carried out gently and slowly to reduce the operation efficiency. In addition, there is a safety problem, since these gases are toxic to human being.

OBJECTS AND SUMMARY OF THE INVENTION

A primary object of this invention is to provide a casting apparatus for casting a molten metal in a mold in an inert or reducing gas atmosphere.

A further object of this invention is to provide such a casting apparatus by which the operation efficiency is appreciably improved.

A still further object of this invention is to provide such a casting apparatus by which leakage of toxic gases is excluded to ensure safe operation.

A specific object of this invention is to provide a casting apparatus having a casting chamber which may be sealingly closed to be evacuated, at least one of an inert gas or a reducing gas being then introduced into the evacuated casting chamber to reach a predetermined equilibrium state under which a molten metal is cast into a mold.

More specifically, the present invention provides a casting apparatus comprising a casting chamber for containing a mold is a sealingly closed condition, a vacuum pump for evacuating said casting chamber, gas supply source for supplying at least one of an inert gas or a reducing gas to said casting chamber, and a ladle for containing a molten metal, said molten metal being poured into said mold after said casting chamber is evacuated and then said inert gas or reducing gas is flown into said casting chamber.

DESCRIPTION OF THE DRAWINGS

The above and other objects and features of the invention will become apparent from the detailed description of a preferred embodiment thereof with reference to the appended drawings, wherein.

DETAILED DESCRIPTION OF PREFERRED EMBODIMENT

Figure 1:
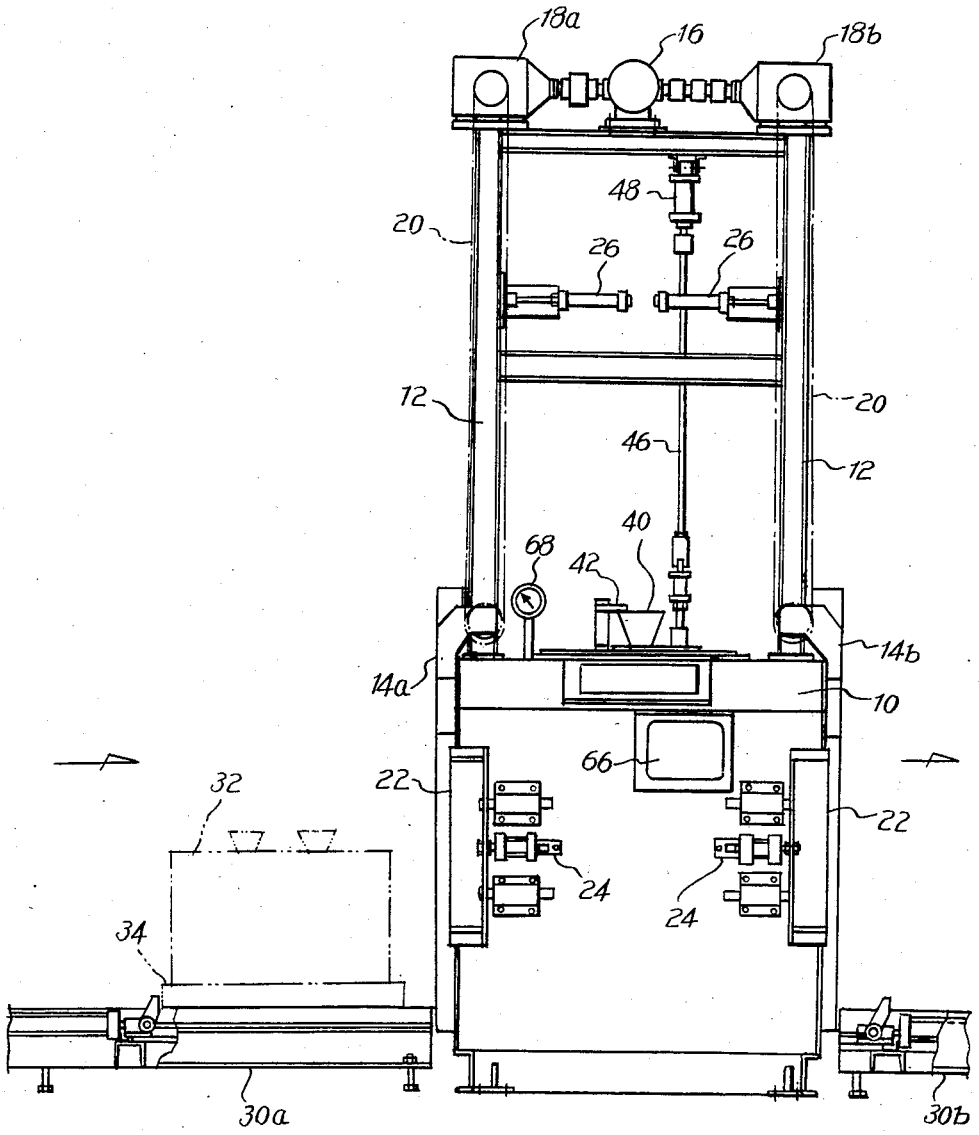
FIG. 1 is a front elevation of one embodiment of the invention.
Figure 2:
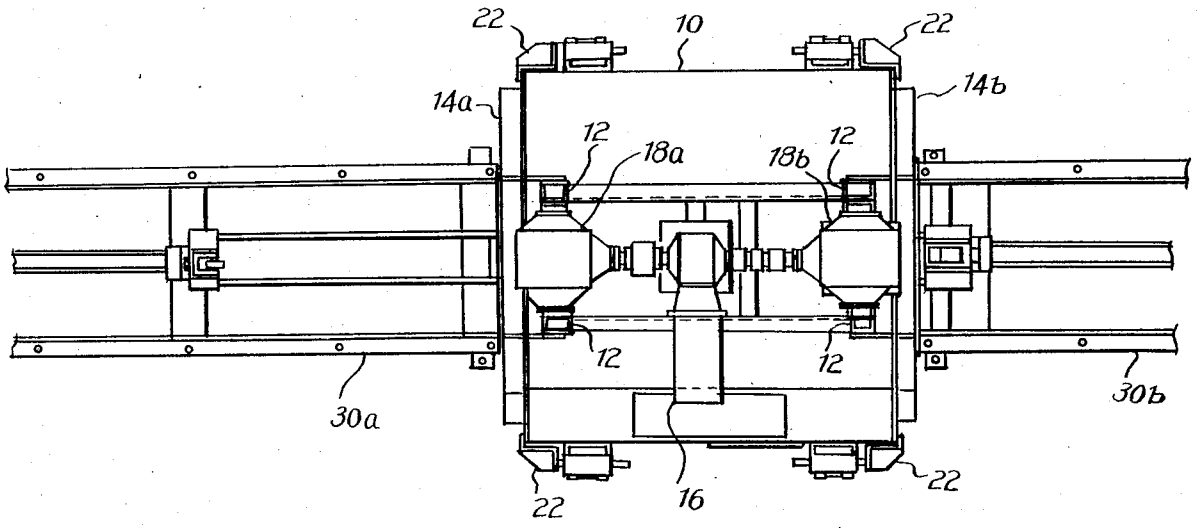
FIGS. 2 and 3 are, respectively, a plan view and a right side elevation of the embodiment shown in FIG. 1.

In the drawings, reference numeral 10 designates a casing of generally tunnel-like configuration, on which four guide rails 12 extend upward to guide door plates 14 (14*a*, 14*b*). The door plates are moved between the upper open position and the lower closing position by actuating a motor 16 mounted above the guide rails 12. The driving force from the motor 16 is transmitted through reduction gear boxes 18 (18*a*, 18*b*)to four chains 20 to move the door plates 14 simultaneously in the upward or downward direction. The side edges of the door plates 14 are engaged by clamps 22 when they are moved to the lower closing position. The door plates 14 are sealingly pressed on the opening edges of the casing 10 by tightly applying the clamps 22 on the side edges of the door plates 14 by the action of air cylinders 24. Also shown in FIG. 1 are air cylinders 26 (26*a*, 26*b*) for locking the door plates 14 at the upper open position.

Guide tracks 28 extend along the bottom of the casing 10 to be connected to external conveyer means 30 (30*a*, 30*b*) when the door plates 14 are opened. A sintered ceramic shell mold 32 maintained at a desired temperature is carried by a pallet 34 and conveyed by the conveyer means 30*a* to be positioned at a pre-set position in the casing 10. After the completion of casting operation, the mold containing a molten metal is conveyed out of the casing 10 by the conveyer means 30*b*.

Figure 3:
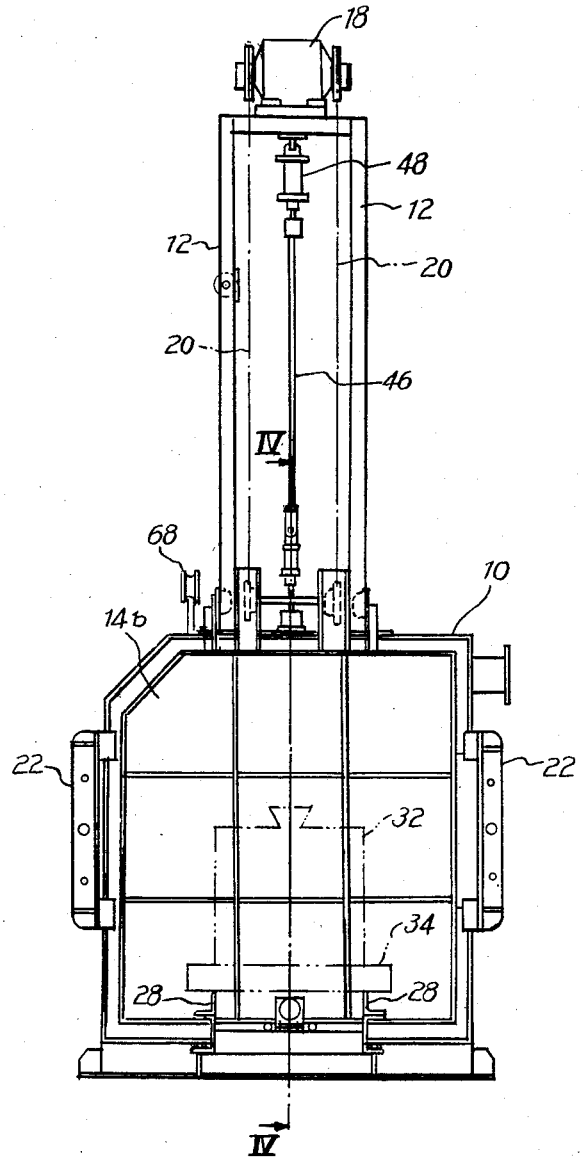

A ladle 36 is disposed on the top wall of the casing 10 and surrounded by a heater 38 to form an electric furnace. The ladle 36 has an inlet port 40 through which a molten metal is filled therein, and the inlet port 40 is closed by a lid 42 after the molten metal is filled. A valve port 44 is formed through the bottom of the ladle 36, the valve port 44 being opened or closed by moving a valve rod 46 extending through the top wall of the casing 10. An air cylinder 48 for moving the valve rod 46 in the upward and downward directions is shown in FIGS. 1 and 3. The casing 10 and the ladle 36 may be sealingly closed by closing the door plates 14*a*, 14*b* and the lid 42 so that a casting chamber 50 is formed within the casing 10.

Figure 4:
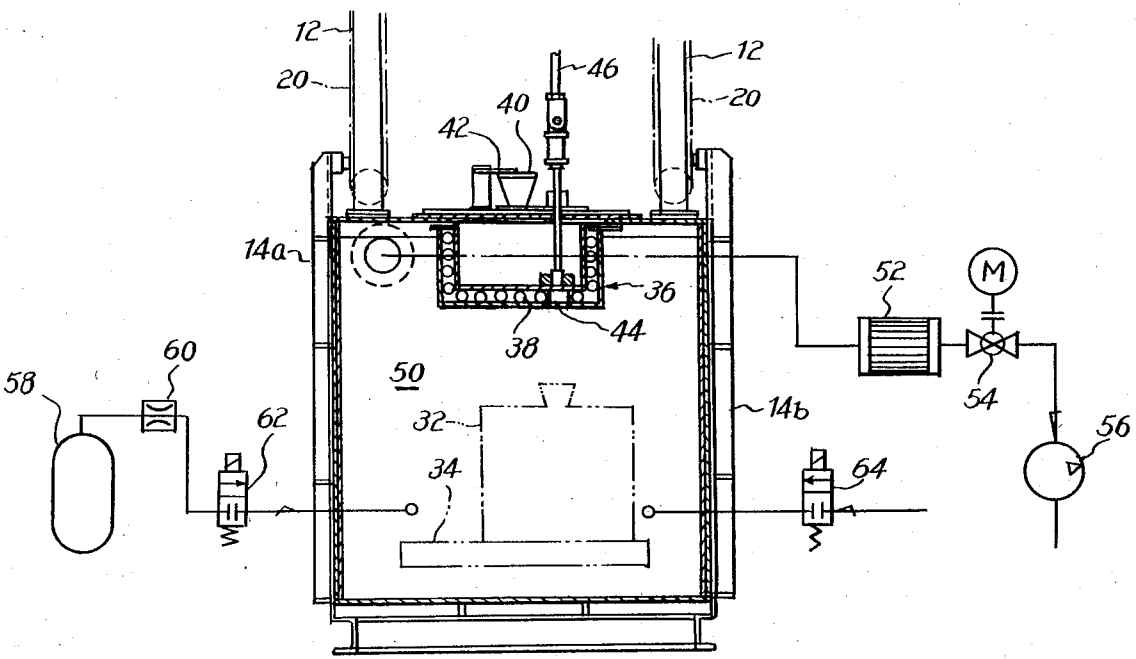
FIG. 4 is a sectional view taken along line IV–IV of FIG. 3.

As best seen from FIG. 4, the casing 10 is communicated through a cooler 52 and a motor-actuated ball valve 54 to a vacuum pump 56. The chamber surrounded by the casing 10 may be evacuated by opening the ball valve 54 and then energizing the vacuum pump 56. Referring to FIG. 4, a gas bomb 58 containing an inert gas, such as $SF_6$, or a reducing gas is communicated through a regulator valve 60 and an opening-closing valve 62 with the chamber surrounded by the casing 10. The bomb 58 and the valves 60 and 62 constitutes the gas supply means. Also provided is a valve 64 for communicating the casting chamber with the atmosphere. Reference numeral 66 in FIG. 1 designates a glass window on the front wall of the casing 10, and reference numeral 68 in FIGS. 1 and 3 designates a vacuum gauge for visually inspecting the pressure in the casting chamber. The reduced pressure in the casting chamber 50 is detected by another not-shown vacuum indicator to generate an electric signal to control the pressure in the casting chamber 50 automatically by operating the valve 54, the pump 56, the opening-closing valves 62 and 64 and the air cylinder 48 for moving the valve rod 46.

Figure 5:
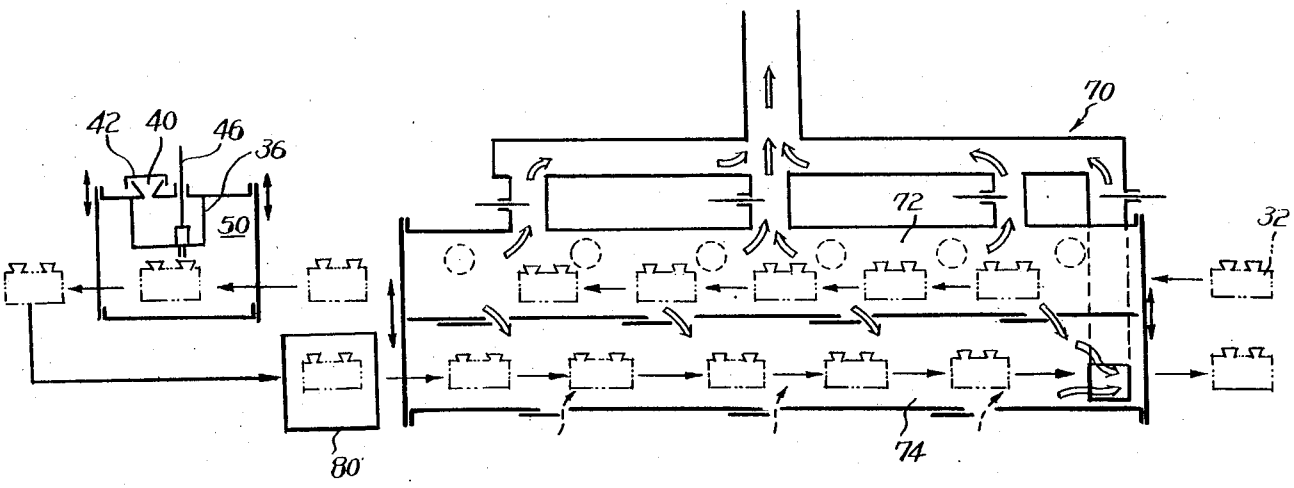
FIG. 5 is a schematic illustration showing the operation of the apparatus of the invention.

The operation of a system including the aforementioned embodiment of the invention will now be described with reference to FIG. 5. The aforementioned embodiment is combined with a sintering-annealing furnace 70. The sintering-annealing furnace 70 has an upper sintering furnace 72 and a lower annealing furnace 74, both being of tunnel-like shape, and dewaxed ceramic shell molds 32 are moved through the sintering furnace 72 by means of a conveyer. A magnesium alloy, commonly referred to as AZ-91, is to be cast in the molds, the molds are sintered at a temperature of about 700° C. On the other hand, the magnesium alloy is melted in a melting furnace at about 800° C., and the surface of the molten metal bath is covered with a smelting flux to prevent the alloy from burning. A predetermined amount of the molten alloy is put into the ladle 36 as fast as possible by suitable means and covered with a small quantity of a smelting flux. After the temperature of the molten alloy in the ladle 36 reaches a predetermined temperature (about 740° to 700° C.), a mold 32 is passed from the sintering furnace 72 to the casting chamber 50. A strainer is put on the sprue port of the mold 32. After closing the door plates 14 and the lid 42, the vacuum pump 56 is actuated to reduce the pressure in the casting chamber 50. When the pressure in the casting chamber 50 is reduced by about 650 mmHg from the atmospheric pressure, the valve 54 is closed and the pump 56 is stopped. The valve 62 is then opened to allow the $SF_6$ gas to flow into the chamber 50, whereupon the pressure in the chamber 50 increases. When the pressure in the chamber 50 reaches the level lower than about 550 mmHg from the atmospheric pressure, the air cylinder 48 is operated to move the valve rod 46 upward to open the valve port 44, whereby casting in the mold 32 is initiated. It is preferred that the casting operation be completed before the pressure in the chamber 50 reaches the level lower than 450 mmHg from the atmospheric pressure. Completion of casting is ascertained by viewing through the glass window 66, and the $SF_6$ gas supply is stopped by closing the valve 62 and then the valve 64 is opened to communicate the casting chamber 50 with the atmosphere. It is desirous that the operation of filling the molten alloy in the ladle 36 and the operation of casting it into the mold 32 are completed within about 2 minutes. After the $SF_6$ gas is purged from the casting chamber 50, the door plates 14 is opened and the sprue port of the mold 32 is covered with a smelting flux for preventing burning of the alloy. Then, the mold 32 is put in a cooling apparatus, where cold air flows are blown from a spot cooler onto the mold 32 for about 2 minutes to cool the mold and the cast alloy forcibly and rapidly to a temperature higher than the eutectoid forming temperature. Thereafter, the cast alloy is slowly cooled in the annealing furnace 74. Since the magnesium alloy shrinks greatly in the temperature range near the eutectoid forming temperature due to phase shift, the cast alloy is slowly cooled in the annealing furnace over a sufficient time period to pass through the eutectoid forming temperature range slowly, whereby the cast product is prevented from cracking due to stress between the mold 32 and the cast alloy contained therein. The cast alloy is cooled to about 200° C. for 60 to 90 minutes in the annealing furnace 74.

Although a magnesium alloy has been cast in the illustrated example, the apparatus of the invention may be advantageously used for casting any other metals or alloys. Since the casting chamber is evacuated to a level at which the molten alloy is cast substantially in vacuum in the illustrated example, the cast molten alloy is degased rapidly to provide a high quality cast product containing little impurity and to suppress the metal-mold reaction between magnesium and silicon dioxide contained in the mold with an additional effect that the cast alloy is evenly filled in the mold. However, the objects of the invention may be attained at a relatively low degree of reduced pressure.

The apparatus of the invention may be used for casting a molten metal not only in a shell mold but also in other types of mold, such as a solid mold.

What is claimed is:

1. A casting apparatus comprising a casting chamber for containing a mold in a sealingly closed condition, said chamber having an entrance door on one side of said chamber to enable said mold to be put into said casting chamber and an exit door on another side of said chamber to enable said mold to be removed from said casting chamber, a guide track for holding said mold, said guide track extending along the bottom of said casting chamber and being connected to external conveyer means mounted externally of said chamber at each of said doors, an actuator means for opening and shutting off said entrance door, another actuator means for opening and shutting off said exit door, a vacuum pump for evacuating said casting chamber, a gas supply source for supplying at least one of either an inert gas or a reducing gas to said casting chamber, and a ladle for containing a molten metal, said ladle being disposed on said casting chamber, a port at the bottom of said ladle communicating with said casting chamber, said mold being positioned in said casting chamber and below said port, said inert gas or reducing gas flowing into said casting chamber after said casting chamber is evacuated, and said molten metal in said ladle thereafter pouring through said port and into said mold below said port and in said casting chamber.

2. The casting aparatus according to claim 1, wherein an inert gas is supplied from said gas supply source.

3. The casting apparatus according to claim 2, wherein said inert gas is selected from the group consisting of sulfur hexafluoride and nitrogen.

4. The casting apparatus according to claim 1, wherein a reducing gas is supplied from said gas supply source.

5. The casting apparatus according to claim 4, wherein said reducing gas is selected from the group consisting of carbon monoxide and sulfurous acid gas.

* * * * *